United States Patent [19]

Hull et al.

[11] Patent Number: 4,775,875

[45] Date of Patent: Oct. 4, 1988

[54] ELECTROSTATIC IMAGE TONING MECHANISM

[75] Inventors: Joan H. Hull; Albert T. Frenzel, Jr., both of Rochester, N.Y.

[73] Assignee: Eastman Kodak Company, Rochester, N.Y.

[21] Appl. No.: 108,610

[22] Filed: Oct. 15, 1987

[51] Int. Cl.[4] ..... G03G 15/00; G03G 15/01; G03G 15/09

[52] U.S. Cl. ..... 355/3 DD; 355/4; 118/645; 118/657

[58] Field of Search ..... 355/3 DD, 4, 14 D; 118/645, 654, 656–658

[56] References Cited

U.S. PATENT DOCUMENTS

| | | | |
|---|---|---|---|
| 4,264,185 | 4/1981 | Ohta | 355/4 |
| 4,398,817 | 8/1983 | Nishimura et al. | 355/3 DD X |
| 4,452,173 | 6/1984 | Tabuchi et al. | 355/3 DD X |
| 4,533,229 | 8/1985 | Lu | 355/3 DD |
| 4,639,124 | 1/1987 | Nye, Jr. et al. | 355/4 X |
| 4,714,046 | 8/1987 | Steele et al. | 355/3 DD X |

FOREIGN PATENT DOCUMENTS

| | | | |
|---|---|---|---|
| 147365 | 8/1984 | Japan | 355/4 |
| 166595 | 8/1984 | Japan | 355/4 |

*Primary Examiner*—A. T. Grimley
*Assistant Examiner*—Ed Pipala
*Attorney, Agent, or Firm*—Leonard W. Treash

[57] ABSTRACT

A mechanism for toning electrostatic images has two storage means for developer containing toner of different characteristics, for example, different colors. A rotational applicator rotates in one direction to transport developer from one storage, past the other storage, to a development zone and back to the storage. The applicator moves in the opposite direction to similarly transport developer from the other storage. A shield blocks the unused storage means in each mode. By transporting developer past the unused storage means on the way to the development zone, the developer can simply fall into the appropriate storage means on leaving the development zone.

6 Claims, 3 Drawing Sheets

ELECTROSTATIC IMAGE TONING MECHANISM

FIELD OF THE INVENTION

This invention relates to the field of toning electrostatic images, and, more particularly, to a mechanism for selectively applying either of two toners to an electrostatic image.

BACKGROUND ART

U.S. Pat. No. 4,398,817 shows a magnetic brush toning apparatus for applying either of two toners to an electrostatic image with the same applicator. The toners are contained in storage means around a rotary applicator. When the applicator is rotated in a clockwise direction a first developer is moved directly from its storage means through a toning zone and then is stripped off the applicator and returned by a complicated return mechanism around the other storage means to its original storage means. When the applicator is turned in a counterclockwise direction toner is moved from the second storage location past the toning zone and is stripped and returned through a second return path around the first developer storage means to its correct storage means.

According to this patent, this structure permits toning an electrostatic image with either of two different colored toners with a single applicator. However, the structure requires an elaborate return mechanism for spent developer to prevent it from falling into the storage location for the other color developer.

STATEMENT OF THE INVENTION

It is the object of this invention to provide a mechanism for applying toner to an electrostatic image generally of the type described but in which an elaborate return mechanism for the developer is not required.

This and other objects are accomplished by a toner applying mechanism which includes an applicator means having a rotatable component and first and second storage means for first and second developers containing toner, which means are positioned such that developer from each storage means is transported past the other storage means on its way to a development zone, permitting that developer to return directly to its respective storage means after passing through the development zone.

According to a preferred embodiment, a shield is moveable into a blocking position between the developer being moved to the development zone and the other storage means providing a space between the applicator means and the shield means for movement of developer.

According to a further preferred embodiment the applicator means is of the type which includes generally stationary internal magnetic means to hold the developer to a rotating non-magnetic cylindrical shell. At least a portion of the magnetic means is moveable between two positions providing respective gaps in magnetic field adjacent the return path of developer to permit developer to fall from the cylindrical shell into that storage means after passing through the development zone. For example, a portion of a set of magnets inside the rotating shell may be moveable to provide substantial magnetic force over the delivery path to the development zone and reduce magnetic force away from the development zone in each of the respective modes of operation of the mechanism.

According to another preferred embodiment a small rotary magnet member is rotatable adjacent the development zone, a device known per se, but which direction of rotation is reversible according to which developer storage location is being used. This rotary magnet member contributes to movement of developer through the development zone, agitates developer in the zone and enhances image development.

SPECIFIC DESCRIPTION OF THE DRAWINGS

Figure 1:
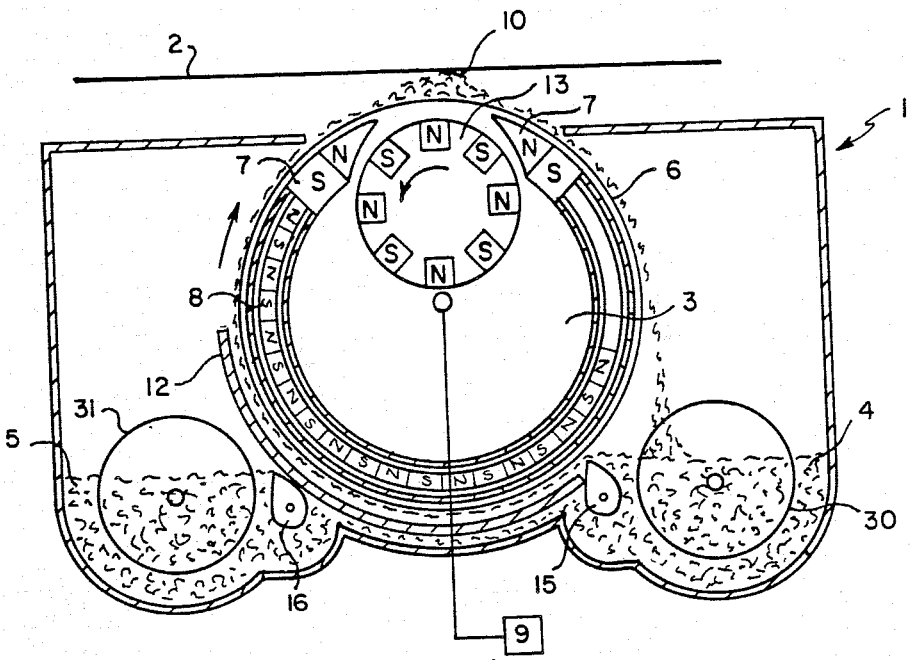
FIGS. 1 and 2 are schematic cross-sections of the mechanism for applying toner according to the invention shown in first and second modes of operation, respectively.
Figure 2:
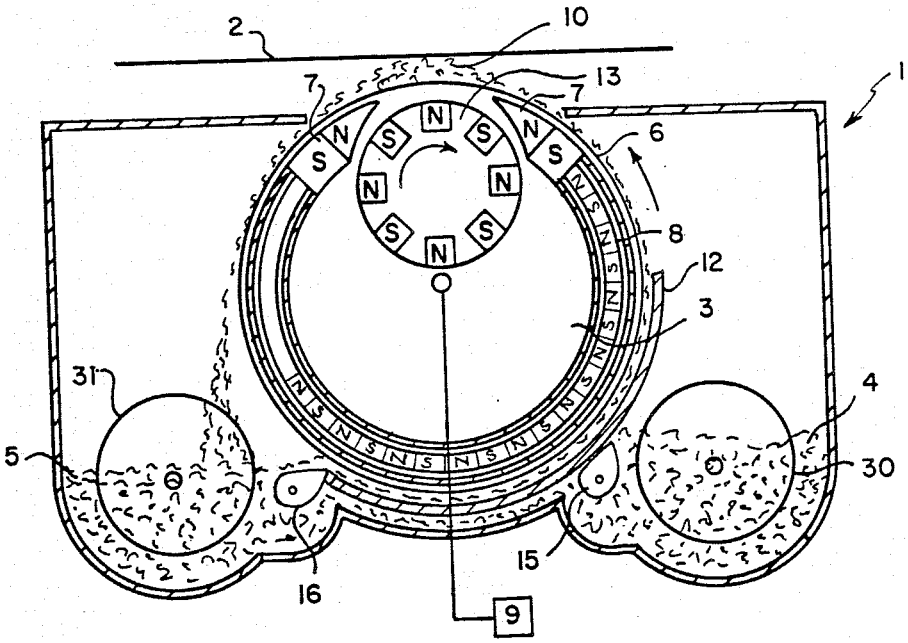
Figure 3:
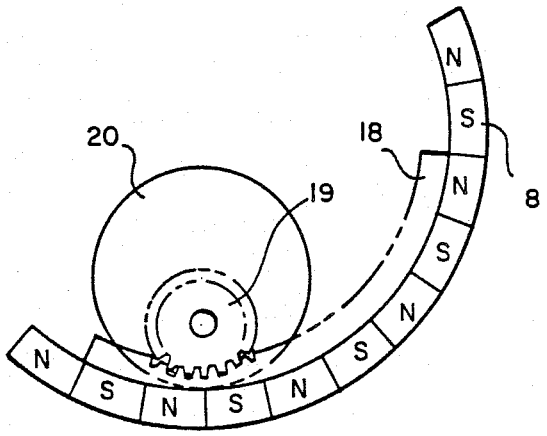
FIGS. 3 and 4 are schematic cross-sections of a moving magnetic section of the FIGS. 1 and 2 mechanism in the first and second modes respectively.
Figure 4:
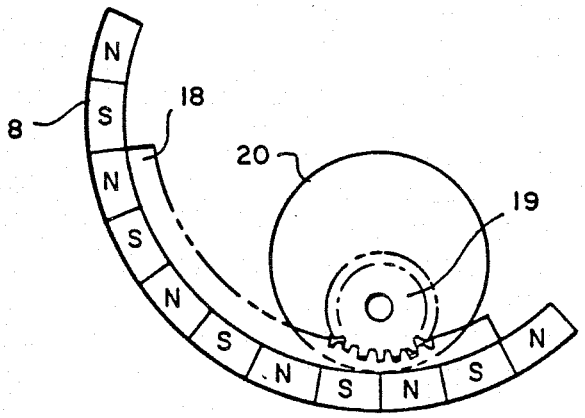
Figure 5:
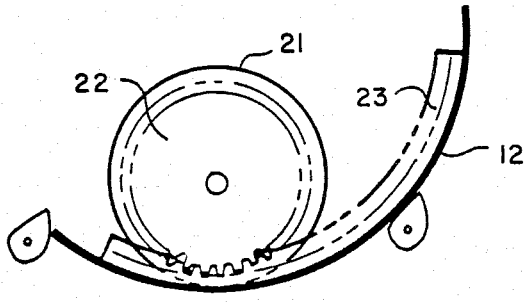
FIGS. 5 and 6 are schematic cross-sections of a shield means in its first and second modes respectively.
Figure 6:
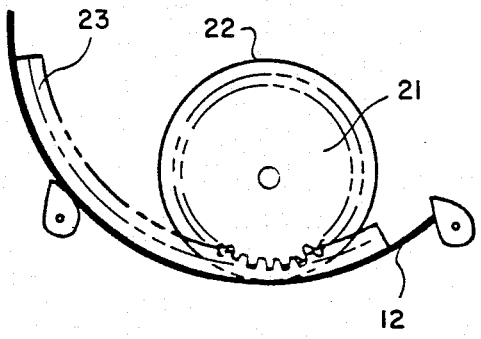

According to FIGS. 1 and 2 a toner applying mechanism 1 applies toner to an electrostatic image carried by an insulating surface 2. The mechanism 1 includes a magnetic applicator means 3 and first and second developer storage means 4 and 5.

The magnetic applicator means 3 includes a rotatable non-magnetic cylindrical shell 6 which is rotatable both clockwise and counterclockwise by suitable means, shown schematically in FIGS. 1 and 2 as motor 9. A series of magnets is located closely adjacent the inner surface of shell 6 and include stationary magnets 7 and moveable magnets 8. Stationary magnets 7 are located on opposite sides of a development or toning zone 10 while the moveable magnets constitute a portion of the arc away from the development zone between the stationary magnets. The moveable magnets can be moved from a position, as shown in FIG. 1 where the magnets leave a gap directly above the first developer storage means 4 to a position in which the magnets leave a gap directly above the second developer storage means 5, as shown in FIG. 2.

A shield 12 is located around the lower portion and slightly spaced from shell 6. It is also moveable between positions in which it blocks toner from the second development storage means 5 from entering the area adjacent the shell 6 as shown in FIG. 1 to a location in which it similarly blocks developer from the first developer storage means 4.

A development enhancing rotary magnetic member 13 is located within the shell 6 adjacent the development zone 10 and is rotatable in both clockwise and counterclockwise directions. First and second moveable skives 15 and 16 are controlled by the location of shield 12.

In a first mode of operation shield 12 and moveable magnets 8 are moved to the positions shown in FIG. 1. The cylndrical shell 6 is rotated in a clockwise direction pulling toner out of first developer storage means 4 as controlled by skive 15 into the space between shield 12 and cylindrical shell 6 and hence around applicator means 3 in a clockwise direction until developer reaches the development zone 10. Rotary magnet member 13 is moved in a counterclockwise direction thereby continuing the movement of the developer across the development zone and agitating the developer to enhance development of the electrostatic image in a manner generally known, per se. As the developer leaves the development zone it reaches a position in which there is a gap in stationary and moveable magnets 7 and 8 at which point it falls directly back into the first developer storage means 4.

In its second mode of operation movable magnets 8 and the shield 12 are moved to the positions shown in FIG. 2 thereby permitting skive 16 to move to a skiving position controlling the amount of developer now moving from second developer storage means 5 into the space between shield means 12 and cylindrical shell 6. Rotary magnetic member 13 is now moved in a clockwise direction as shown in Fig. 2. The shell 6 is rotated in a counterclockwise direction and operation is the same as in the first mode but using developer coming from the second developer storage means 5 moving around applicator means 3 in a counterclockwise direction.

Thus the developer is carried first from one of the storage means 4 or 5 past the other storage means and to the development zone 10. This path of travel permits the developer when it leaves development zone 10 to fall directly into the appropriate sump 4 or 5 without an elaborate return mechanism.

The first and second developer storage means 4 and 5 each contain mixing mechanisms 30 and 31, outlined schematically, which can be paddle wheels, ribbon blenders or other suitable structure known in the art.

Movements of the moveable magnets 8 and the shield 12 can be accomplished by a bidirectional motor or rotary solenoids, the latter being shown in FIGS. 3, 4, 5 and 6. According to FIG. 3 the moveable magnets 8 are shown in the FIG. 2 position and are coupled to an internal gear 18 which meshes with a spur gear 19 controlled by a first rotary solenoid 20. According to FIG. 4, when solenoid 20 is actuated it rotates spur gear 19 to also rotate internal gear 18 and move moveable magnets 8 from their FIG. 2 position to their FIG. 1 position. According to FIGS. 5 and 6 a similar structure is used with a second solenoid 21 to move shield 12. Solenoid 21 rotates spur gear 22 which is meshed with internal gear 23 which is connected to shield 12 to move shield 12 from its position shown in FIG. 2 and FIG. 5 to its position shown in FIG. 1 and FIG. 6.

This invention can be used to apply any two toners selectively to an electrostatic image. In its preferred application, the two toners are of different color, and provide a highlight color option for a printer or copier, without the space or expense of two separate toning mechanisms. Alternatively, two such mechanisms can be included in the same apparatus to provide conventional four-color reproduction.

This invention uses its advantages best with multicomponent developers, with a toner starved carrier portion of the developer returning to the storage means. However, it is also usable with monocomponent developer in which the toner makes up the entire developer with excess toner-developer falling into the appropriate storage means.

This invention has been described in detail with particular reference to preferred embodiments thereof, but it will be understood that variations and modifications can be effected within the spirit and scope of the invention.

We claim:

1. A mechanism for applying toner comprising part or all of a particulate developer to an electrostatic image, comprising:

first and second developer storage means;

applicator means adjacent said first and second developer storage means, for transporting particulate developer from said first and second storage means into toning relation with an electrostatic image in a development zone and back to said storage means, said applicator means including a rotatable component, rotatable in a first direction to transport developer from the first storage means to the development zone and rotatable in a second direction opposite said first direction to transport developer from the second storage means to said development zone, said first and second storage means being positioned such that developer from each storage means is transported past the other storage means on its way to the development zone thereby permitting return of developer from the development zone directly to its respective storage means.

2. A mechanism according to claim 1 further comprising shield means moveable between a first position blocking access of developer located in said second storage means to said applicator means and providing a space between said shield and said applicator means for transporting developer from said first storage means and a second position blocking access of developer from said first storage means to said applicator means and providing a space between said shield means and said applicator means for transporting developer from said second storage means.

3. A mechanism according to claim 1 wherein said applicator means includes a rotatable non-magnetic cylindrical shell and a magnetic means located inside and adjacent said shell which magnetic means is moveable between a first position providing a gap in magnetic field adjacent the return path of developer to said first storage means and a second position providing a gap in magnetic field associated with the return path of developer to said second storage means.

4. A mechanism according to claim 3 further including a rotary magnet member located inside said shell and adjacent said development zone which rotary magnet member is rotatable a clockwise direction while said shell is rotating in a counterclockwise direction and is rotatable in a counterclockwise direction while said shell is rotating in a clockwise direction to agitate and transport developer in and across said development zone.

5. A mechanism according to claim 1 wherein said first and second developer storage means include developer containing toners of different colors.

6. A mechanism for applying toner to an electrostatic image, comprising magnetic applicator means for transporting particulate developer containing toner from a storage location into toning relation with an electrostatic image in a development zone and back to said storage location, said magnetic applicator means including a rotatable component rotatable in a first direction to transport developer from a first storage location to said development zone and rotatable in a second direction opposite said first direction to transport developer from a second location to said development zone;

said first and second locations being positioned such that developer from each location is transported past the other location on its way to the development zone, and such that developer can return directly to its respective storage location after passing through said development zone

* * * * *